US007516863B2

(12) United States Patent
Siegers et al.

(10) Patent No.: US 7,516,863 B2
(45) Date of Patent: Apr. 14, 2009

(54) LINER FOR A CONTAINER

(75) Inventors: Terence Dieter Siegers, Rotterdam (NL); Philip Jan Groen, Rotterdam (NL)

(73) Assignee: Dacro B.V., Rotterdam (NL)

( * ) Notice: Subject to any disclaimer, the term of this patent is extended or adjusted under 35 U.S.C. 154(b) by 613 days.

(21) Appl. No.: 10/895,260

(22) Filed: Jul. 21, 2004

(65) Prior Publication Data

US 2005/0040163 A1 Feb. 24, 2005

(30) Foreign Application Priority Data

Jul. 22, 2003 (NL) ..... 1023975

(51) Int. Cl.
*B65D 90/04* (2006.01)

(52) U.S. Cl. ..... 220/1.6

(58) Field of Classification Search ..... 220/1.6, 220/495.06, 495.05, 495.04, 661, 1.5, 495.01; 217/3 BC, 3 R; *B65D 88/22, 88/16*
See application file for complete search history.

(56) References Cited

U.S. PATENT DOCUMENTS

| | | | | | |
|---|---|---|---|---|---|
| 3,173,539 | A * | 3/1965 | Looker | 206/597 |
| 3,294,034 | A * | 12/1966 | Bodenheimer et al. | 410/1 |
| 4,601,405 | A * | 7/1986 | Riemer | 220/1.5 |
| 5,040,693 | A * | 8/1991 | Podd, Sr. et al. | 220/1.5 |
| 5,137,170 | A * | 8/1992 | Matias | 220/495.01 |
| 5,421,476 | A * | 6/1995 | Matias | 220/1.6 |
| 5,482,425 | A * | 1/1996 | Podd, Jr. et al. | 414/527 |
| 5,489,037 | A * | 2/1996 | Stopper | 220/1.5 |
| 5,626,254 | A * | 5/1997 | Podd et al. | 220/1.6 |
| 5,657,896 | A * | 8/1997 | Matias | 220/1.6 |
| 6,113,031 | A * | 9/2000 | Williams et al. | 244/118.1 |
| 6,755,232 | B1 * | 6/2004 | Holland et al. | 160/368.1 |
| 2003/0197009 | A1 * | 10/2003 | Mino | 220/1.6 |

FOREIGN PATENT DOCUMENTS

| | | | |
|---|---|---|---|
| DE | 10122885 | A1 * | 11/2002 |
| DK | 1012885 | | 11/2002 |
| EP | 331491 | A1 * | 9/1989 |
| FR | 2461661 | | 2/1981 |
| FR | 2461661 | A * | 3/1981 |
| NL | 1018396 | | 1/2003 |
| NL | 1018396 | C * | 1/2003 |

* cited by examiner

*Primary Examiner*—Anthony D Stashick
*Assistant Examiner*—Robert J Hicks
(74) *Attorney, Agent, or Firm*—Lowe, Hauptman, Ham & Berner, LLP

(57) ABSTRACT

A liner for a container has an upper wall, a bottom wall as well as a front wall, a rear wall and side walls interconnecting the upper wall and the bottom wall. Straps extending over the front wall are provided, which straps are provided with extensions extending outside the front wall, which extensions can be attached to inner walls of the container with their free ends.

21 Claims, 2 Drawing Sheets

LINER FOR A CONTAINER

RELATED APPLICATIONS

The present application is based on, and claims priority from, The Netherlands Application Number 1023975, filed Jul. 22, 2003, the disclosure of which is hereby incorporated by reference herein in its entirety.

1. Field of the Invention

The invention relates to a liner for a container comprising an upper wall, a bottom wall as well as a front wall, a rear wall and side walls interconnecting said upper wall and said bottom wall wherein spaced apart straps extending horizontally over the front wall are provided, which straps are provided with extensions extending outside the front wall, which extensions can be attached to inner walls of the container with their free ends and spaced apart straps extending upwards from the bottom of the liner are connected to the front wall.

2. Background of the Invention

Liners are frequently used for the transportation of bulk goods in containers, which liners are suspended in the containers in empty condition. After being placed in the container, the liner can be filled via a filling opening which is generally present near the upper side of the front wall, i.e. the wall that is present near the opening of the container that can be closed by means of doors. The unloading of such a container filled with bulk goods can take place via a discharge opening, which is generally present near the bottom side of the front wall, In many cases, the container is placed on a tilting frame for being unloaded, by means of which tilting frame the container can be placed in an inclined position, such that the bulk goods can easily flow to the discharge opening.

Usually, a number of horizontally extending bars arranged one above another are provided near the opening of the container that can be closed by means of doors, which bars function to retain the liner and its contents within the container, preventing the front wall from bulging out undesirably under the influence of the weight of the contents of the) liner and also preventing the liner and the contents thereof sliding out of the container upon tilting of the container for the purpose of being unloaded.

Such bars, which are usually galvanised, are costly. Furthermore, the transport of the liner with the bars to the user is difficult and costly, on account of the great weight and the great length of the bars. Furthermore, the bars are generally used only once, since the receiver of the bulk goods will generally discard the bars.

SUMMARY OF THE INVENTION

The object of the invention is to obtain a liner which obviates the drawbacks that are experienced when bars are used and wherein an adequate support at the front wall will be obtained.

According to the invention this object can be obtained in that said upwardly extending straps are fixed to the front wall with their parts extending between the bottom wall and the upper strap of said horizontally extending straps, while the remaining parts of said upwardly extending straps extend loosely along and above the front wall and can be attached to inner walls of the container with their parts free ends.

By using the structure according the invention there is obtained an effective support of the heavily loaded front wall of the liner.

BRIEF DESCRIPTION OF THE DRAWING

The invention will be explained in more detail hereinafter by means of an embodiment of a liner according to the invention as schematically shown in the appended FIGS.

DETAILED DESCRIPTION OF THE INVENTION

Figure 2:
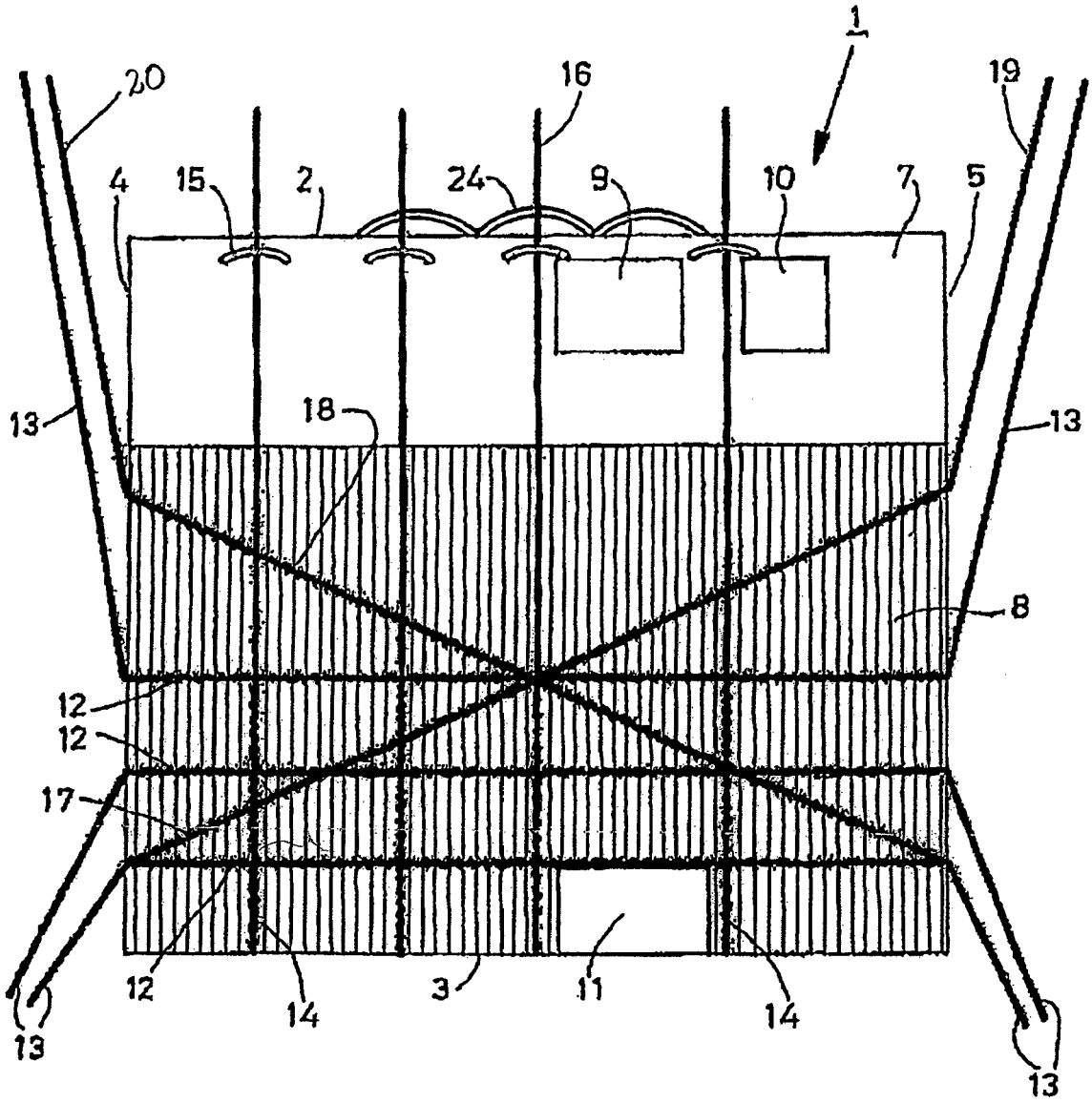
FIG. 2 is a schematic front view of the liner that is shown in FIG. 1.

The liner 1 that is shown in the FIGS. comprises an upper wall 2, a bottom wall 3, two side walls 4 and 5 as well as a rear wall 6 and a front wall 7. In the illustrated embodiment, the front wall 7 is provided with a reinforcing layer 8 (vertically hatched in FIG. 2), which extends from the bottom 3 along approximately two-thirds of the height of the front wall.

Near the upper end of the front wall, a filling duct 9 and a vent circuit 10 are provided in a usual manner, whilst a discharge duct 11 is provided near the bottom side of the front wall.

Three horizontal, spaced-apart straps 12 are fixed, for example stitched, to the front wall over the lower part of the front wall 7, which comprises about 40% of the overall height of the front wall. Said straps have extensions 13 extending outside the front wall, which can be fixed to the inner walls of the container by means of fasteners (not shown) provided near the free ends of said extensions upon placement of the liner 1 in the container.

Furthermore, a number of regularly spaced-apart, vertically extending straps 14 are connected to the front wall, which straps are fixed, for example stitched, to the front wall along that portion of their length which extends from the bottom 3 of the liner to the upper strap of the horizontally extending straps 12. The remaining portions of the straps 14 abut loosely against the front wall, and they are passed through loops 15, which are attached to the front wall, near the upper wall 2 of the liner. The extensions 16 of the straps 14 extending above the upper wall 2 can be fixed to the inner side of the upper wall of the container upon placement of the liner.

Said straps 14 prevent the front wall 7 of the liner from deforming, in particular upon filling of the liner with bulk goods, such that the discharge duct 11 gets wedged or is compressed under a "sagged" front wall 7. Especially the straps near the sides of the discharge duct 11 are very effective in this regard.

Furthermore, two straps 17 and 18 extending crosswise are attached, for example stitched, to the front wall, which straps each extend obliquely upwards from an end of the lower horizontal strap 12 located near a side wall of the liner to a point on the opposite wall of the liner, which point is spaced from the bottom wall 3 by a distance which amounts to approximately 65% of the overall height of the front wall 7. Said straps 17 and 18 are likewise provided with extensions 19 and 20, respectively, at their upper ends, which extensions can be fixed to the inner wall of the container with their ends upon placement of the liner in a container. The lower ends of the straps 17 and 18 are connected to the extensions 13 of the lower horizontal strap 12.

Figure 1:
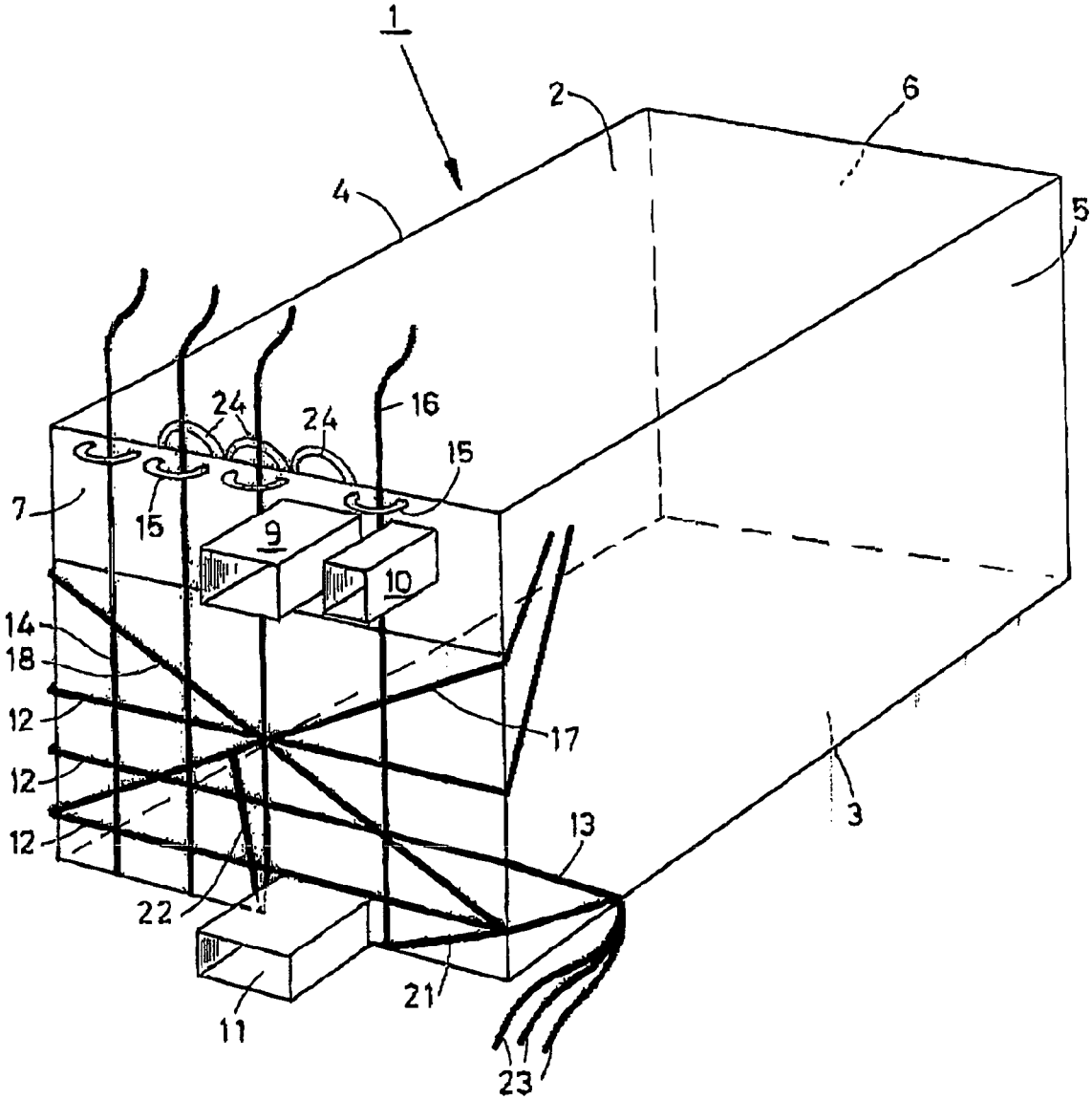
FIG. 1 is a schematic, perspective view of a liner to be placed in a container.

As is furthermore shown In FIG. 1, straps 21 and 22 are attached to the bottom wall of the container, which straps extend obliquely to the rear from the connection of the discharge duct 11 to the front wall 7, in the direction of the side walls, at which location they are provided with extensions 23, which can be fixed to the inner wall of the container again with their ends upon placement of the liner in the container.

Usual loops 24 are furthermore provided near the location where the upper wall 2 joins the front wall 7, by means of which loops the liner can be suspended from the upper edge of the door opening when the doors of the container are open.

It will be apparent that an effective support of the front wall of the liner can be effected by means of the straps that are attached to the front wall, which straps are attached to the inner wall of the container with their extensions. Said straps will not increase the weight of the liner to any significant extent, and furthermore said straps will not be lost, since they are fixed to the liner and can be transported as one whole together with the liner.

The invention claimed is:

1. A liner for a container, said liner comprising:

an upper wall;

a bottom wall;

a front wall;

a rear wall;

side walls interconnecting said upper wall to said bottom wall, and said front wall to said rear wall;

wherein, a plurality of horizontal straps extend horizontally over the front wall and include a bottommost horizontal strap located near a bottom edge of the front wall and a topmost horizontal strap located above said bottommost horizontal strap towards an upper edge of the front wall, said horizontal straps having extensions adapted to be attached to a plurality of inner walls of the container;

a plurality of vertical straps extend vertically over the front wall, a first portion of each of said vertical straps, disposed in between said bottommost horizontal strap and said topmost horizontal strap, is attached to said front wall while the remaining second portion of said vertical strap extends, without being directly attached to the front wall, between the topmost horizontal strap and the upper edge of the front wall;

a lower portion of the front wall is provided with a reinforcing layer;

the horizontal straps are located only on the lower portion of the front wall where the reinforcing layer is present; and the first portion of each of the vertical straps is attached to the front wall only where the reinforced layer exists and the second portion of the vertical strap extends over both the reinforcing layer and an upper portion of the front wall where the reinforcing layer does not exist.

2. The liner according to claim 1, wherein said vertical straps are passed through a plurality of loops, respectively, said loops being attached to the front wall, near the upper wall of the liner.

3. The liner according to claim 1, wherein at least one of said vertical strap is adjacent to each side of a discharge duct connecting to the front wall of the liner.

4. The liner according to claim 1, wherein a plurality of cross straps extend diagonally over the front wall, a portion of each of said cross straps is fixed to the front wall.

5. The liner according to claim 4, wherein each of said cross straps extends obliquely upwards over the front wall from the bottom horizontal strap.

6. The liner according to claim 1, wherein bottom straps extending obliquely to the rear wall in opposite directions from a discharge opening are connected to the bottom wall, said bottom straps are provided with extensions extending outside the bottom wall.

7. The liner as claimed in claim 1, wherein a distance between said topmost horizontal strap and said bottommost horizontal strap is at least 0.4 times a height of the front wall.

8. The liner as claimed in claim 4, wherein a height of a topmost part of the fixed portion of each of said cross straps is at least 0.65 times a height of the front wall.

9. The liner as claimed in claim 1, wherein an entire portion of each of said horizontal straps extending over the front wall is fixed to the front wall.

10. The liner as claimed in claim 1, wherein said reinforcing layer having a height of at most two-third times a height of the front wall.

11. The liner as claimed in claim 1, wherein the reinforced layer extends over an entire width of the front wall, said reinforced layer is present between adjacent said straps.

12. The liner as claimed in claim 1, wherein a plurality of cross straps extend diagonally over the front wall, a portion of each of said cross straps is fixed to the front wall.

13. The liner as claimed in claim 12, wherein an entirety of the fixed portion of the cross straps are located on the reinforced layer.

14. The liner as claimed in claim 1, wherein the second portion of each said vertical strap further extends beyond the upper edge of the front wall and is free of direct attachment with both the front wall and the upper wall.

15. The liner as claimed in claim 14 further comprising a plurality of primary loops attached to the front wall and along the upper edge of the front wall, the second portion of each said vertical strap passes through a corresponding one of the primary loops.

16. The liner as claimed in claim 15 further comprising a plurality of secondary loops attached to the upper wall and along the upper edge of the front wall.

17. The liner as claimed in claim 16, wherein the second portions of at least two of the vertical straps each pass through one of the secondary loops.

18. The liner as claimed in claim 17, wherein the loose ends of the second portions passing through said secondary loops are adapted to be connected to an upper edge of a door opening of the container.

19. The liner as claimed in claim 15, wherein each of said second portions is horizontally moveable within the boundary defined by the respective primary loop.

20. The liner as claimed in claim 17, wherein each of said second portions of said at least two vertical straps is horizontally moveable within the boundary defined by the respective secondary loop.

21. The liner as claimed in claim 20, wherein each of said second portions is horizontally moveable within the boundary defined by the respective primary loop.

* * * * *